US007731070B2

(12) United States Patent
Meyer

(10) Patent No.: US 7,731,070 B2
(45) Date of Patent: Jun. 8, 2010

(54) METHOD AND DEVICE FOR APPLYING A PRESSURE ROLLER TO A GOODS GUIDING ROLLER

(75) Inventor: Ernst Meyer, Lindau (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 315 days.

(21) Appl. No.: 11/883,453

(22) PCT Filed: Jan. 23, 2006

(86) PCT No.: PCT/DE2006/000103

§ 371 (c)(1),
(2), (4) Date: Jul. 30, 2007

(87) PCT Pub. No.: WO2006/081792

PCT Pub. Date: Aug. 10, 2006

(65) Prior Publication Data

US 2008/0149680 A1 Jun. 26, 2008

(30) Foreign Application Priority Data

Feb. 1, 2005 (DE) ..... 10 2005 004 814.5

(51) Int. Cl.
*B65H 20/00* (2006.01)

(52) U.S. Cl. ..... 226/177; 226/176; 226/154

(58) Field of Classification Search ..... 226/175, 226/176, 177, 179, 180, 186, 187, 154, 155
See application file for complete search history.

(56) References Cited

U.S. PATENT DOCUMENTS 4,048,831 A 9/1977 Fabian et al.
4,119,256 A 10/1978 Vogtmann et al.
4,364,505 A * 12/1982 Schockman ..... 226/154
5,007,272 A * 4/1991 Matsunaga et al. ..... 72/226
5,072,872 A 12/1991 Casset et al.
5,738,264 A * 4/1998 Jackson et al. ..... 226/177
5,904,094 A * 5/1999 Bredenberg ..... 101/216
6,378,749 B1 * 4/2002 Robin ..... 226/90
6,533,154 B2 * 3/2003 Kitai et al. ..... 226/177
6,991,145 B1 * 1/2006 Ho ..... 226/177

FOREIGN PATENT DOCUMENTS

DE 26 53 725 6/1978
DE 195 07 396 2/1996
DE 103 44 710 5/2005
GB 1 588 247 4/1981

* cited by examiner

*Primary Examiner*—Evan H Langdon
(74) *Attorney, Agent, or Firm*—W. F. Fasse; W. G. Fasse

(57) ABSTRACT

A method and an apparatus are for applying a rotationally driven pressure roller (4) onto a rotationally driven goods guiding roller (3) in stretching equipment for thermoplastic films. The pressure roller (4) is advanced in the direction of the goods guiding roller (3) by at least one first pressurizable piston-cylinder unit (7) in such a manner so that after the advancement an axis-parallel remaining stroke exists between the pressure roller (4) and the goods guiding roller (3). Then at least one second pressurizable piston-cylinder unit (8) operatively connected with the first piston-cylinder unit (7) carries out the remaining stroke, while maintaining the axis-parallelism, until a touching contact exists between the pressure roller (4) and the goods guiding roller (3). Then the pressure roller (4) becomes effective with a nominal pressing force onto the goods guiding roller (3).

2 Claims, 2 Drawing Sheets

METHOD AND DEVICE FOR APPLYING A PRESSURE ROLLER TO A GOODS GUIDING ROLLER

FIELD OF THE INVENTION

The invention relates to a method and an apparatus for applying a rotatably supported pressure roller that cooperates with a rotationally driven goods guiding roller.

BACKGROUND INFORMATION

The treatment of band-shaped or strip-shaped goods, for example strip-shaped thermoplastic or metallic films or foils, is carried out, among other things, with equipments or installations having rotationally driven goods guiding rollers. Such goods guiding rollers cooperate with rotationally driven pressure rollers, on the one hand especially to prevent air from becoming entrapped between the goods guiding rollers and the strip-shaped goods, and on the other hand to obtain a sufficient friction between the roller and the foil or film. With a thermoplastic film, for example, air inclusions or entrapments between the goods guiding roller and the pressure roller are avoided in that a pressure roller equipped with a rubberized roller jacket or sheath is pressed on the linear forward end or take-up of the film onto the goods guiding roller.

The pressing must be carried out linearly and with a nearly constant pressure level of the pressure roller over the width of the film, and particularly on the forward end or take-up of the goods guiding roller. With a relatively large spacing distance of the bearings taking up the rollers, it is complicated to satisfy this abovementioned requirement, because on the one hand the flexing or bending deflection of the roller increases with increasing spacing distance of the bearings, and on the other hand the applied pressing force leads to the result that the linear contact of the rollers over the width of the goods is lost, that is to say the rollers only still have touching contact in the area of their ends, while no pressing force is achieved in the middle area. A further increase of the pressing force leads to no better result, more likely to a further increase of the gap between the rollers. In the operation with a small pressing force distributed uniformly over the roller width, it was determined that in this pressure range, the friction of the piston packing seals or sleeves in a pneumatic piston-cylinder unit prevents an exact adjustment of the pressing force of the pressure roller onto the goods guiding roller. Upon increasing the working pressure the friction forces of the piston-cylinder unit would be overcome, but however, simultaneously an undesirably high pressing force would be realized, which leads to the above mentioned deficiencies.

From the German patent publication DE 103 44 710 of the same assignee as the present US application, there is known a method and an apparatus for the regulation of the pressing force of a pressure roller onto a goods guiding roller, with which a prescribed nominal or rated pressing force of a pressure roller that can be applied onto a goods guiding roller with at least one pneumatically driven piston-cylinder unit is not exceeded. This prior invention of DE 103 44 710 remedies the abovementioned disadvantages.

In practice it has been shown, however, that in addition to the regulatable pressing force of the applied pressure roller, also the attainment of the touching contact between the rollers and the film has a decisive influence on the quality of the film. In order to avoid disadvantageous effects on the quality of the film in connection with the touching contact, before being applied the pressure roller is driven with a circumferential velocity that corresponds to the film velocity. Furthermore it is advantageous if a linear touching contact simultaneously arises on the entire roller width between the rollers and the film. This requirement is, however, difficult to satisfy, due to the typical dimensions in the field of the film stretching equipments or machines and the correspondingly large rollers with correspondingly large masses, because one must work with large pneumatically driven piston-cylinder units. Typically in this regard, rollers with a mass of, for example, 1800 kg are used. For moving this mass a certain minimum diameter of the piston-cylinder units is required. For safety reasons and for easier pulling-in of the goods, a certain minimum spacing distance between the rollers in the retracted position is furthermore required. This minimum spacing distance must be overcome during the applying of the pressure roller and thus necessitates a certain minimum stroke of the piston-cylinder units. Sufficiently dimensioned pneumatic piston-cylinder units, however, do not carry out exactly uniform movements due to the friction of the piston packing seals or sleeves, and have a long actuation time due to the large volume and limited air volume flows. The abovementioned invention can therefore not remedy the disadvantage of the non-uniform applying of the pressure roller onto the goods guiding roller.

SUMMARY OF THE INVENTION

Thus, the object of the present invention is to provide a method and an apparatus with which a simultaneous touching contact on the entire roller width is ensured during the applying of a pressure roller onto a goods guiding roller, whereby a prescribed nominal or rated pressing force between the goods guiding roller and the pressure roller is exceeded neither during the contacting or applying process nor during the further operation.

The object is achieved according to the invention in that the operation or actuation of the pressure roller is achieved through at least two double-acting piston-cylinder units that are operatively connected via a lever and that carry out an application of the pressure roller in two method steps and ensure an axis-parallel uniform contacting or application and the maintenance of a nominal or rated pressing force.

Therefore, a method is provided according to the invention, whereby a first double-acting piston-cylinder unit shifts or slidingly displaces the pressure roller in the direction of the goods guiding roller up to the end stop of the first piston-cylinder unit. The end stop of the first piston-cylinder unit is adjusted so that the pressure roller lies with a prescribed remaining stroke axis-parallel to the goods guiding roller. At the end stop of the piston of the first piston-cylinder unit, a second piston-cylinder unit, which is operatively connected via a lever with the first piston-cylinder unit, acts advantageously as a shock absorber.

The pressure P1 for acting on or pressurizing the first piston-cylinder unit is adjusted so high that the exerted cylinder force of the first piston-cylinder unit is greater than the force of the second piston-cylinder unit acting via the lever. Thus, the first piston-cylinder unit acts as a rigid connection during the following method steps.

Thereafter, the second piston-cylinder unit is acted on or pressurized with pressure P2. The second piston-cylinder unit now carries out the remaining stroke, acting via the force-amplifying lever and via the first piston-cylinder unit. Thereby the axis-parallelism is maintained. Thereby a simultaneous touching contact over the entire roller width is achieved. The pressure P2 is adjusted so that the desired pressing force arises between the rollers.

The lever with a force-amplifying lever ratio makes possible a correspondingly small dimensioning of the second piston-cylinder unit with correspondingly small cylinder volumes and small friction forces of the seal packing sleeves. Two advantages arise from this. First, the remaining stroke is carried out nearly simultaneously and with uniform velocity on both lateral bearings of the pressure roller, because the cylinder volume is small and therewith the reaction time of the piston-cylinder unit is short. Thereby the axis-parallelism is maintained during the remaining stroke and the nearly simultaneous touching contact over the entire roller width is ensured. Thereby a disadvantageous impairment of the goods quality is avoided, which would arise with a one-sided touching contact. Secondly, with the inventive solution, in an advantageous manner, a nearly constant pressing force of a pressure roller onto a goods guiding roller is achieved over the length of the rollers, whereby this pressing force can be maintained in narrow limits, while avoiding air inclusions or entrapments between the roller surface and the goods web or strip, and furthermore the surface of the goods guided over the goods guiding roller does not suffer any qualitative impairments.

In connection with moving away the pressure roller, at first the second piston-cylinder unit remains driven-in or retracted and thereby advantageously acts as a damper at the end stop of the first piston-cylinder unit. After reaching the end stop of the first piston-cylinder unit, the second piston-cylinder unit is driven out or extended. Thereafter the apparatus is again ready to start for the next start-up or approaching process.

For carrying out the method, an apparatus is provided according to the invention, whereby a pressure roller is rotatably supported in carrier arms arranged spaced apart from one another, which carrier arms are rigidly connected with the guide carriages of at least one equipment-fixed linear guide, whereby respectively at least one first piston-cylinder unit is effective on each carrier arm. The first piston-cylinder unit is acted on or pressurized with compressed air from a pressure source via a first pressure regulating valve, a first control valve and via pressure lines.

The first piston-cylinder unit establishes an operative connection between the carrier arms and a lever that is pivotable about an equipment-fixed rotation point, wherein the free end of the lever is operatively connected with the piston rod of a second piston-cylinder unit. The cylinder of the second piston-cylinder unit is operatively connected with an equipment-fixed point. The second piston-cylinder unit is acted on or pressurized with compressed air from the pressure source via the first pressure regulating valve, via a second pressure regulating valve, via a second control valve and via pressure lines. The first and the second control valve is connected in a signal transmitting manner with the electronic controller of the equipment. In further embodiment of the invention, respectively two position switches are arranged on the end positions of the pistons on the first and on the second piston-cylinder unit, which position switches are connected in a signal transmitting manner with the electronic controller of the apparatus or equipment.

BRIEF DESCRIPTION OF THE DRAWINGS

In the following, the invention is explained more closely in connection with an example embodiment.

In the drawings.

DETAILED DESCRIPTION OF EXAMPLE EMBODIMENTS OF THE INVENTION

Figure 1:
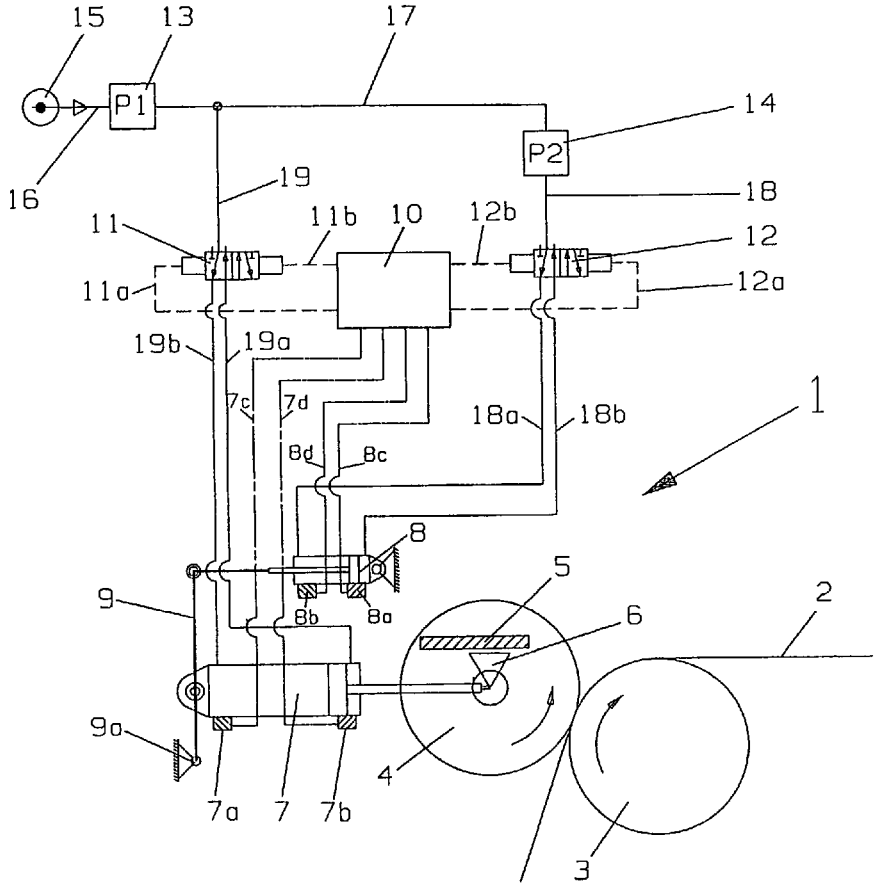
FIG. 1 shows the schematic illustration of an apparatus by means of which a method according to the invention can be carried out.
Figure 2:
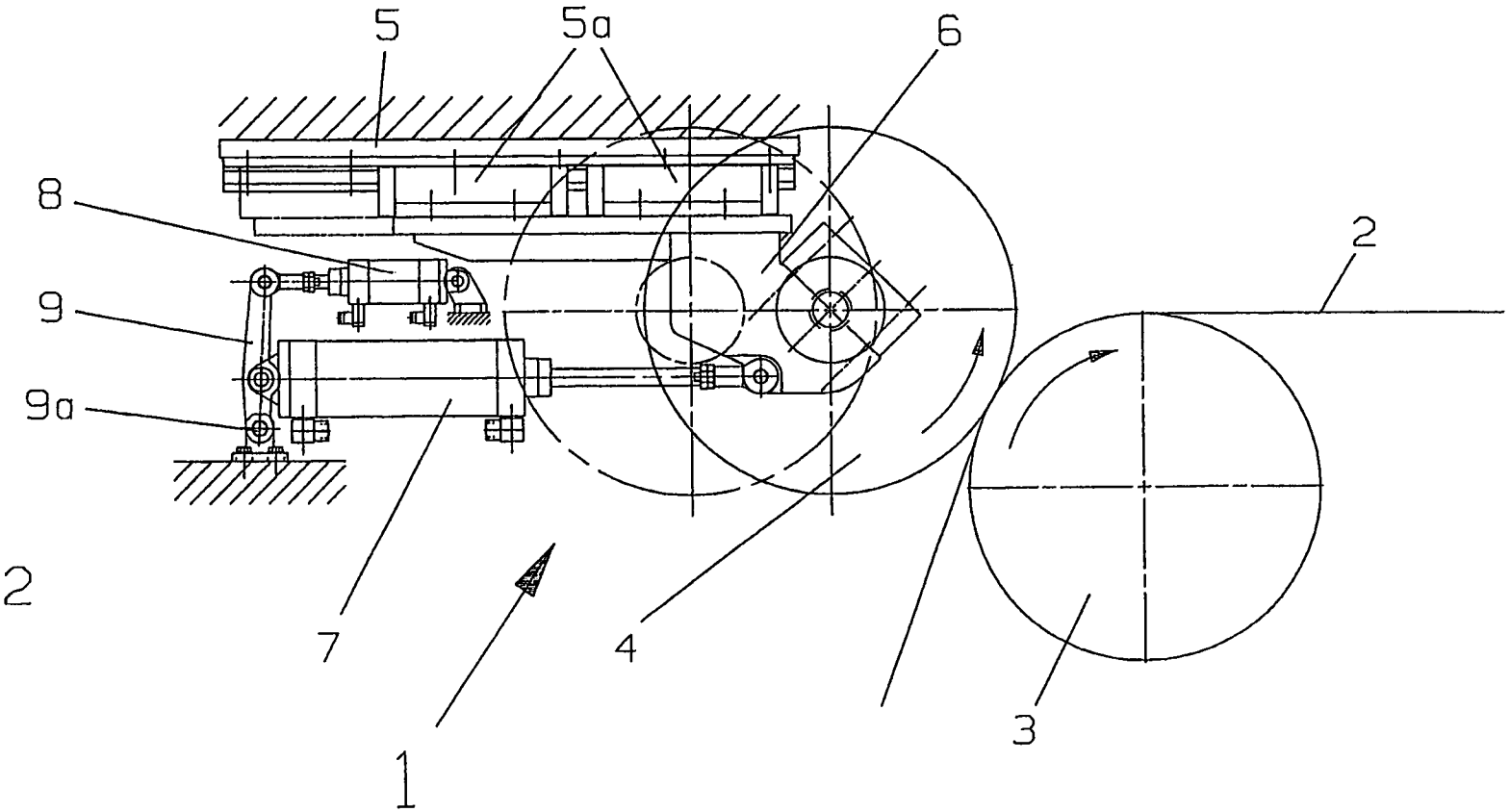
FIG. 2 shows an embodied arrangement of the present invention in the side view without control components.

In the schematically illustrated apparatus 1, for contacting or applying a pressure roller 4 onto a rotationally driven goods guiding roller 3 that guides a goods web or strip such as a film web 2, a first double-acting piston-cylinder unit 7 is provided, which is operatively connected via a lever 9 with a second double-acting piston-cylinder unit 8. The lever 9 is pivotably moveable about an equipment-fixed rotation point 9*a*. The pressure roller 4 is laterally supported in a carrier arm 6, which is rigidly connected with the guide carriage 5*a* of a linear guide 5. Respectively one illustrated apparatus 1 is arranged on both lateral ends of the pressure roller 4.

If the electronic controller 10 receives, from the operator of the apparatus or equipment, the signal for moving the pressure roller 4 onto the goods guiding roller 3, then the controller 10 tests whether the starting conditions are satisfied. For that purpose, the first piston-cylinder unit 7 must be entirely driven-in or retracted. This is signaled to the controller 10 by the position switch 7*a* via the signal line 7*c*. Furthermore, the second piston-cylinder unit 8 must be entirely driven-out or extended. This is signaled to the controller by the position switch 8*b* via the signal line 8*d*. If the starting conditions are present, then the controller 10 sends a signal via the signal line 11*b* to a first control valve 11. The control valve 11 is actuated and the first piston-cylinder unit 7 is supplied with compressed air via the pressure line 19*b*. The required compressed air flows from the pressure source 15 via the pressure lines 16, 17, 19 and 19*b* into the first piston-cylinder unit 7. The pressure P1 for acting on or pressuring the first piston-cylinder unit 7 is adjusted on a first pressure regulating valve 13. The first piston-cylinder unit 7 drives out or extends and slidingly displaces the pressure roller 4 in the direction of the goods guiding roller 3 up to the end stop of the first piston-cylinder unit. At the end stop of the piston of the first piston-cylinder unit 7, the second piston-cylinder unit 8 acts as a shock absorber. The position switch 7*b* provides a signal via the control line 7*d* to the controller 10, as soon as the first piston-cylinder unit 7 is completely driven-out or extended.

Thereupon the controller 10 provides a signal to a second control valve 12 via the control line 12*a*. The control valve 12 is actuated, and a second piston-cylinder unit 8 is provided with compressed air via the pressure line 18*a*. The required compressed air flows from the pressure source 15 via the pressure lines 16, 17, 18 and 18*a* into the second piston-cylinder unit 8. The pressure P2 for acting on or pressurizing the second piston-cylinder unit 8 is adjusted at a second pressure regulating valve 14.

The second piston-cylinder unit 8 retracts or drives in, and thereby, via the lever 9 and the rigidly extended first piston-cylinder unit 7, moves the pressure roller 4 in the direction of the goods guiding roller 3, until touching contact exists. The position switch 8*a* sends the signal "second piston-cylinder unit retracted" to the controller 10 via the control line 8*c*. Thereby the operating position of the pressure roller is registered in the controller.

The pressure P2 is adjusted so that the desired pressing force arises between the rollers. The pressure P1 is higher than the pressure P2. Thus it is achieved that the extended piston-cylinder unit 7 acts as a rigid connection in operation and only the pressure P2 determines the pressing force between the rollers.

If the controller 10 receives, from the operator of the apparatus or equipment, the signal for moving away the pressure roller 4, then the controller sends a signal via the signal line 11*a* to the control valve 11. The control valve 11 is actuated and the first piston-cylinder unit 7 is acted on or pressurized with compressed air through pressure line 19*a* in such a manner that the piston drives in or retracts and the pressure roller 4 moves away from the goods guiding roller 3. At the end stop of the piston of the first piston-cylinder unit 7, the second piston-cylinder unit 8 acts as a shock absorber. The position switch 7*a* provides a signal via the control line 7*c* to the controller 10, as soon as the first piston-cylinder unit 7 is completely driven-in or retracted.

Thereupon the controller 10 provides a signal to the second control valve 12 via the control line 12*b*. The control valve 12 is actuated and the second piston-cylinder unit 8 is acted on or pressurized with compressed air via the pressure line 18*b* in such a manner that the piston drives out or extends.

The invention claimed is:

1. Method of applying a rotationally driven pressure roller (4) onto a rotationally driven goods guiding roller (3), in a stretching equipment for thermoplastic films, whereby the pressure roller is advanced in the direction of the goods guiding roller (3) by at least one first piston-cylinder unit (7), which is pneumatically pressurized via a first control valve (11), so that after the advancement an axis-parallel remaining stroke exists between the pressure roller (4) and the goods guiding roller (3), characterized in that thereupon at least one second piston-cylinder unit (8), which is pneumatically pressurized via a second control valve (12), carries out the remaining stroke via a force amplifying lever (9) and via the first piston-cylinder unit (7) while maintaining the axis-parallelism, until a touching contact exists between the pressure roller (4) and the goods guiding roller (3), and that thereupon the pressure roller (4) becomes effective with a pressing force onto the goods guiding roller (3).

2. Apparatus for applying a rotationally driven pressure roller (4) onto a rotationally driven goods guiding roller (3), in a stretching equipment for thermoplastic films, which pressure roller (4) is supported in carrier arms (6) that are spaced apart from one another, and whereby each carrier arm is rigidly connected with guide carriages (5*a*) of at least one equipment-fixed linear guide unit (5), characterized in that at least one pneumatically pressurizable first piston-cylinder unit (7) for advancing the pressure roller (4) is provided, which establishes an operative connection between the carrier arms (6) and a lever (9) that is pivotably moveable about an equipment-fixed rotation point (9*a*), in that a pneumatically pressurizable second piston-cylinder unit (8) for carrying out an axis-parallel remaining stroke between the pressure roller (4) and the goods guiding roller (3) and for exerting a pressing force is provided, which is operatively connected with an equipment-fixed point and with the lever (9) with a force-amplifying lever ratio, in that an electronic controller (10) is provided for controlling pressurization of the piston-cylinder units (7, 8), with which controller a first control valve (11) allocated to the first piston-cylinder unit (7) and a second control valve (12) allocated to the second piston-cylinder unit (8) is connected in a signal transmitting manner, and in that the electronic controller (10) is further connected in a signal transmitting manner with position switches (7*a*, 7*b*, 8*a*, 8*b*) that are allocated to the piston-cylinder units (7, 8).

* * * * *